US011446940B2

(12) United States Patent
Gistas Perez et al.

(10) Patent No.: US 11,446,940 B2
(45) Date of Patent: Sep. 20, 2022

(54) CUTTER ASSEMBLY WITH MOVABLE TRENCH COVER

(71) Applicant: Hewlett-Packard Development Company, L.P., Spring, TX (US)

(72) Inventors: Angel Gistas Perez, Sant Cugat del Valles (ES); Javier Garcia Blanco, Sant Cugat del Valles (ES); Martin Urrutia Nebreda, Sant Cugat del Valles (ES); Joseba Ormaechea Saracibar, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 260 days.

(21) Appl. No.: 16/959,245

(22) PCT Filed: Jan. 31, 2018

(86) PCT No.: PCT/US2018/016195
§ 371 (c)(1),
(2) Date: Jun. 30, 2020

(87) PCT Pub. No.: WO2019/152015
PCT Pub. Date: Aug. 8, 2019

(65) Prior Publication Data

US 2020/0331281 A1 Oct. 22, 2020

(51) Int. Cl.
*B41J 11/70* (2006.01)
*B26D 1/06* (2006.01)

(52) U.S. Cl.
CPC ..... *B41J 11/70* (2013.01); *B26D 1/065* (2013.01); *Y10T 83/8822* (2015.04)

(58) Field of Classification Search
CPC . Y10T 83/04; Y10T 83/8748; Y10T 83/8749; Y10T 83/8821; Y10T 83/8822;
(Continued)

(56) References Cited

U.S. PATENT DOCUMENTS 1,732,148 A * 10/1929 Barrett ..... D06H 7/02 83/614
4,995,745 A 2/1991 Yokoi
(Continued)

FOREIGN PATENT DOCUMENTS

CN 101934529 1/2011
CN 102198762 9/2011
(Continued)

*Primary Examiner* — Phong H Nguyen
(74) *Attorney, Agent, or Firm* — HP Inc. Patent Department

(57) ABSTRACT

A cutter assembly for a printable medium comprises a cutter to cut the printable medium, a trench adjacent to the cutter, and a trench cover, the trench cover at least partially covering the trench. The trench cover is movable between a supporting configuration to support the printable medium, and an open configuration to receive portions of the printable medium in the trench. The cutter assembly comprises an elastic element for biasing the trench cover towards the supporting configuration. The cutter comprises an engaging element and the engaging element engages the trench cover to move the trench cover from the supporting configuration towards the open configuration.

10 Claims, 12 Drawing Sheets

(58) Field of Classification Search
CPC ..... Y10T 83/2216; Y10T 83/2092; Y10T 83/2098; B26D 1/065; B26D 1/04; B26D 1/045; B26D 1/06
USPC ..... 400/621; 101/93.07
See application file for complete search history.

(56) References Cited

U.S. PATENT DOCUMENTS

| | | | | |
|---|---|---|---|---|
| 5,482,389 | A | 1/1996 | Bickoff et al. | |
| 5,727,889 | A | 3/1998 | Koyabu | |
| 5,826,474 | A | 10/1998 | Howard et al. | |
| 6,302,602 | B1 * | 10/2001 | Kiyohara | B41J 11/706 400/621 |
| 6,467,384 | B1 | 10/2002 | Bromley | |
| 6,651,537 | B1 | 11/2003 | Pfeiffer | |
| 7,455,002 | B2 * | 11/2008 | Downing | B29C 66/1122 83/951 |
| 7,547,154 | B2 * | 6/2009 | Kawaguchi | B41J 11/70 400/621 |
| 8,747,000 | B2 | 6/2014 | Hanaoka et al. | |
| 2012/0312228 | A1 | 12/2012 | Sekiguchi et al. | |
| 2015/0014474 | A1 | 1/2015 | Hirabayashi | |
| 2016/0089907 | A1 * | 3/2016 | Murata | B41J 15/042 347/220 |
| 2016/0159601 | A1 | 6/2016 | Nakatsu et al. | |

FOREIGN PATENT DOCUMENTS

| | | | |
|---|---|---|---|
| CN | 102548748 | | 7/2012 |
| CN | 102825918 | | 12/2012 |
| CN | 104647445 | | 5/2015 |
| EP | E1923225 | | 5/2008 |
| EP | 2269785 | | 1/2011 |
| EP | 2556963 | | 2/2013 |
| JP | 63154378 | | 6/1998 |
| JP | 1148553 | | 2/1999 |
| JP | 2001105677 | | 4/2001 |
| JP | 2001310512 | A | 11/2001 |
| JP | 2006175711 | | 7/2006 |
| JP | 2007022070 | | 2/2007 |
| JP | 2017052180 | A | 3/2017 |

* cited by examiner

CUTTER ASSEMBLY WITH MOVABLE TRENCH COVER

BACKGROUND

Some printers include a cutting device to cut a printable medium before or after a printing operation. A cutter assembly can provide guidance for the printable medium through the printer between subsequent cutting steps.

BRIEF DESCRIPTION OF THE DRAWINGS

The following detailed description will best be understood with reference to the drawings, wherein.

DETAILED DESCRIPTION

The printing and/or cutting steps performed by a printer on portions of a printable medium may impact the edges of adjacent portions of the printable medium. By removing short strips from the edges of the printable medium, clean edges may be obtained.

To remove and dispose of dust/chips of the printable medium or the short strips of the edges of the printable medium from the cutting area, a cutting stage of a printer may comprise a trench. To improve the guidance of the printable medium through the cutting area and across the trench, a trench cover may be used which can be selectively moved into an open configuration to receive portions of the printable medium.

Figure 1:
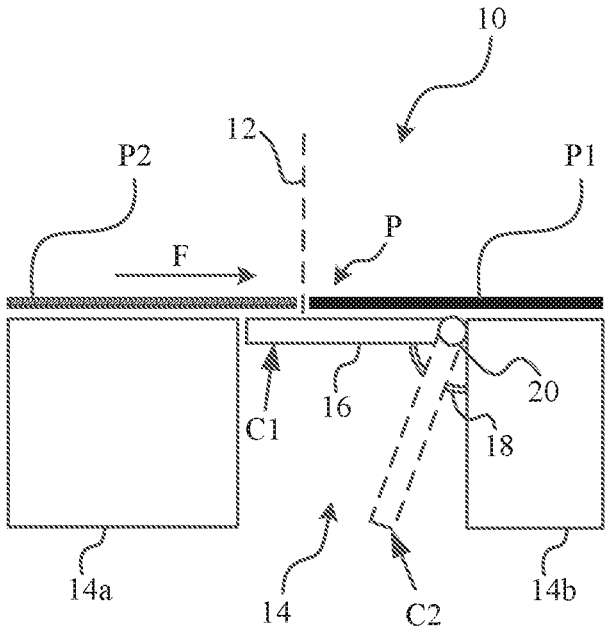
FIG. 1 illustrates a side view of a cutter assembly according to an example.

FIG. 1 illustrates a cutter assembly 10 for a printer to cut a printable medium P supplied along a feeding direction F. The cutter assembly 10 comprises a cutter 12 adjacent to a trench 14. The cutter 12 can cut the printable medium P into first and second portions P1, P2. The trench 14 is formed by trench walls 14*a*, 14*b* and is associated with a trench cover 16. The trench cover 16 at least partially covers the trench 14 and is movable between a supporting configuration C1 to support the printable medium P and an open configuration C2 to receive portions P1 of the printable medium P in the trench 14.

The cutter assembly 10 further comprises an elastic element 18 to bias the trench cover 16 towards the supporting configuration C1. The elastic element 18 may keep the trench cover 16 in the supporting configuration C1, when the trench cover 16 supports the printable medium P. For example, the elastic element 18 may be a deformable medium, which is deformed to move the trench cover 16 between the supporting configuration C1 and the open configuration C2 and provides a restoring force to move the trench cover 16 towards the supporting configuration C1. In some examples, the elastic element 18 comprises a spring.

In the supporting configuration C1, the printable medium P may be supported by the trench cover 16 and may be guided across the trench 14 by the trench cover 16. In the open configuration C2, the printable medium P may be received by and/or fall into the trench 14. For example, if the portion P1 is an offcut of the printable medium P, the trench 14 may receive the portion P1 of the printable medium P after cutting the printable medium P with the cutter 12.

To move the trench cover 16 from the supporting configuration C1 towards the open configuration C2, the cutter 12 comprises an engaging element (not shown in FIG. 1, but illustrated in FIGS. 3-5, 7A, 7B, 9 and 10) to engage the trench cover 16. When the engaging element engages the trench cover 16, the trench cover 16 is rotated about a rotation axis 20 from the supporting configuration C1 towards the open configuration C2 against the restoring force of the elastic element 18. When the engaging element does not engage the trench cover 16, the elastic element 18 moves the trench cover 16 into the supporting configuration C1. Hence, the cutter 12 can control the movement of the trench cover 16 between the supporting configuration C1 and the open configuration C2.

In some examples, the cutter 12 moves in a cutting direction (e.g. along the normal of the section plane of FIG. 1), wherein the engaging element engages the trench cover 16 when the cutter 12 moves or cuts the printable medium P.

During the cutting, the cutter 12 may engage a side surface of the trench cover 16 to keep the trench cover 16 in the supporting configuration C1. The side surface of the trench cover 16 engaged by the cutter 12 during the cutting may be a supporting surface, which is supporting the printable medium P in the supporting configuration C1.

Figure 2:
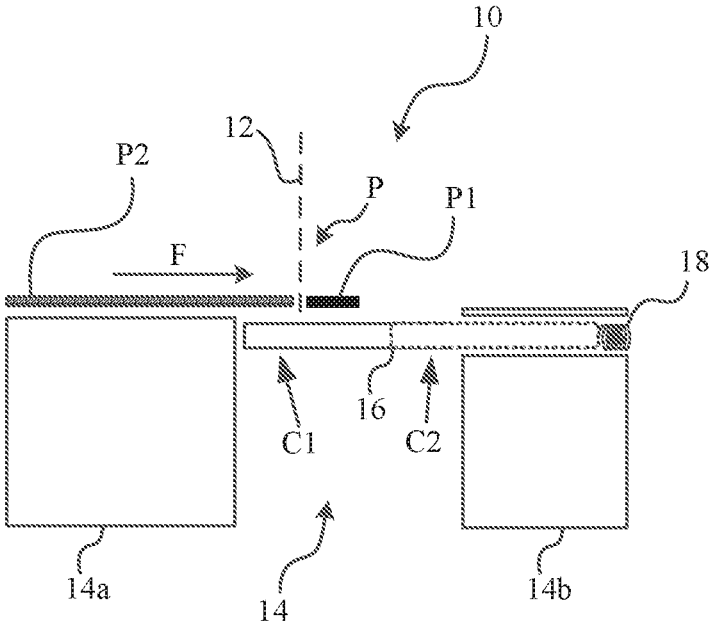
FIG. 2 illustrates a side view of a cutter assembly according to a further example.

FIG. 2 shows a further example of a cutter assembly 10 comprising a cutter 12 adjacent to a trench 14 associated with trench walls 14*a*, 14*b*. The trench 14 is associated with a trench cover 16 which is slidably arranged to be movable between a supporting configuration C1 and an open configuration C2, the supporting configuration C1 at least partially covering the trench 14 and supporting the printable medium P.

Contrary to the example depicted in FIG. 1, in the open configuration C2 illustrated in FIG. 2, the trench cover 16 is not rotatable, but is rather translated to open a connection to the trench 14, such that the trench 14 may receive portions P1 of the printable medium P, in particular translated in a direction parallel to the feeding direction F.

An elastic element 18 comprising a spring biases the trench cover 16 towards the supporting configuration C2. When the engaging element of the cutter 12 engages the trench cover 16, the elastic element 18 may be contracted to retract the trench cover 16 and move the trench cover 16 between the supporting configuration C1 and the open configuration C2. When the engaging element does not engage the trench cover 16, the elastic element 18 moves the trench cover 16 into the supporting configuration C1.

Naturally, any combination of translational or rotational movement, such as the movement illustrated in FIGS. 1 and 2, may be used to move the trench cover 16 from a supporting configuration C1 to support the printable medium P into an open configuration C2 to receive portions P1 of the printable medium P in the trench 14.

In some examples, the trench cover 16 comprises a slot to receive the printable medium P. By performing a rotational and/or translational movement of the trench cover 16, the trench cover 16 is moved from the supporting configuration C1 into an open configuration C2, such that in the open configuration C2 the slot may receive the printable medium P and may guide the printable medium P through the slot into the trench 14, while in the supporting configuration C1 the trench cover 16 may guide the printable medium P across the trench.

In the following, the engaging of the trench cover 16 will be illustrated with the example of a movable cutter 12 linearly moving in a horizontal direction substantially perpendicular to the feeding direction F, wherein the movement of the cutter 12 in the horizontal direction is coupled with a cutting of the printable medium P along the horizontal direction. In this example, the movement of the cutter 12 during cutting leads to an engaging of the engaging element with the trench cover 16. However, any cutter 12 may be used to cut the printable medium P, such as a guillotine or paper cutter, which can cut the printable medium P by a rotational and/or translational movement in an arbitrary direction. Furthermore, the movement of the engaging element to engage the trench cover 16 and the movement of the cutting mechanism of the cutter 12 to cut the printable medium P may be decoupled in some embodiments.

The printable medium P to be cut by the cutter 12 may be any medium on which a printing fluid can be applied. In the following, the functionality of printers, cutter assemblies 10 or methods according to examples will be described with respect to the printable medium P made of paper; however, any printable medium P may be used. For example, the printable medium P may be paper and/or paper-based, such as cardboard, and/or textiles and/or leather and/or polymers and/or combinations thereof, etc.

The printing fluid may be any appropriate material suitable to print a graphical or shaped element onto the printable medium P, such as a printing fluid or a build material. The graphical or shaped element may be a text, an image, lines, shapes, letters, numerals, signs, symbols or a combination of these in an arbitrary color, alignment or shape.

Figure 3:
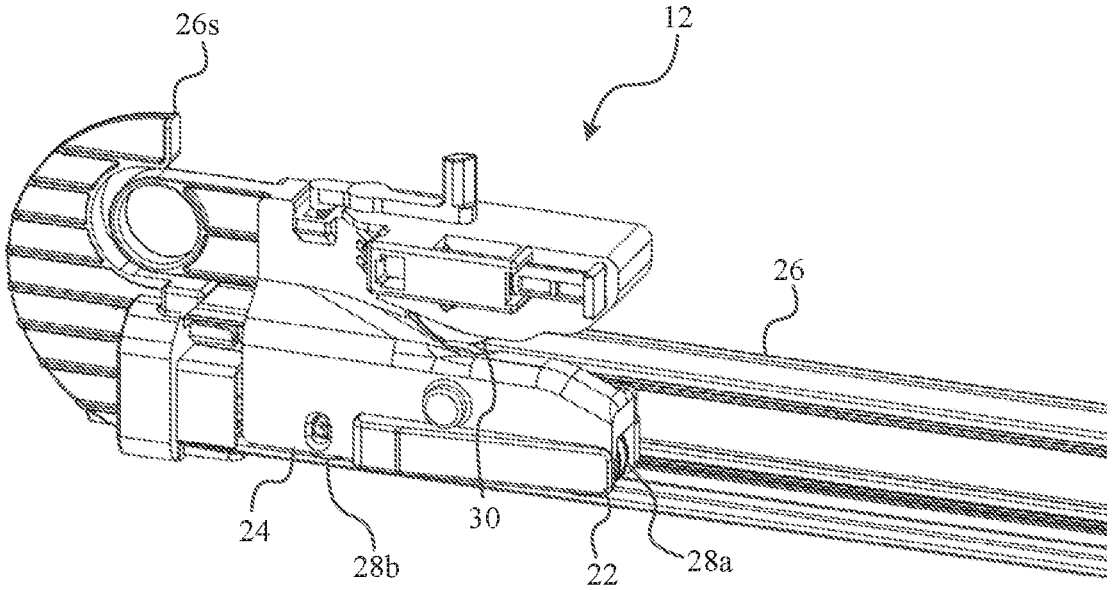
FIG. 3 illustrates a perspective view of a movable cutter according to an example.

FIG. 3 illustrates an exemplary horizontal cutter 12 comprising an engaging element 22 to engage a trench cover 16 of a cutting assembly 10. The cutter 12 comprises a carriage 24 which is movable on rolls 28*a*, 28*b* along a rail 26 and further comprises a cutting blade 30 to cut the printable medium P. The movement of the carriage 24 along the rail 26 may be limited by stop elements 26*s*.

To move the cutter 12 along the rail, any suitable technique may be used such as by driving the movement of the carriage 24 with a belt attached to ends of the rail 26. For example, an external motor or a motor in the carriage 24 may be used to move the belt and drive the carriage 24 along the rail 26. However, the carriage 24 may also be provided with a motor to drive the rolls 28*a*, 28*b* or any other suitable means to move the carriage 24 along the rail 26.

Figure 4:
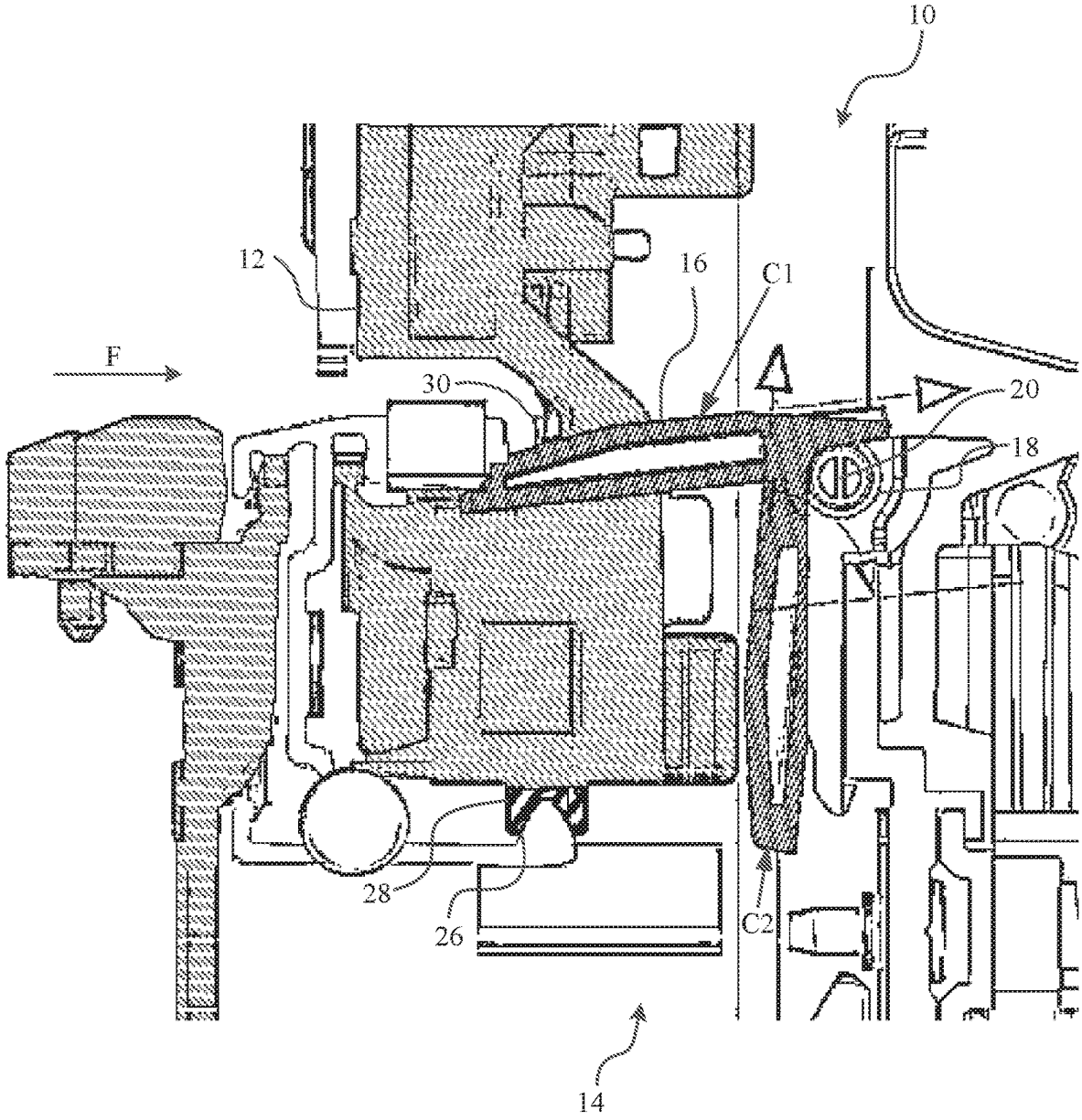
FIG. 4 illustrates a side view of a cutter assembly wherein a cutter engages a trench cover according to an example.

FIGS. 4, 5, 7A and 7B illustrate the engaging of a trench cover 16 of a cutter assembly 10 with a horizontal cutter 12 similar to the cutter 12 illustrated in FIG. 3. FIG. 4 shows the cutter assembly 10 according to a side view along the cutting direction of the cutter 12. The cutter assembly 10 comprises a trench 14 and a trench cover 16, the trench cover 16 being rotatable about a rotation axis 20 and fitted with an elastic element 18 to bias the trench cover 16 towards a supporting configuration C1. The horizontal cutter 12 can move the trench cover 16 towards an open configuration C2 by engaging the trench cover 16 with the engaging element 22 while moving along the rail 26 and while cutting the printable medium P which is supplied along the feeding direction F with the cutting blade 30.

In the example of FIG. 4, the trench cover 16 is rotated about the rotation axis 20 by a rotation angle of 78° to move the trench cover 16 from the supporting configuration C1 into the open configuration C2 and thereby open a connection for the printable medium P into the trench 14. However, any rotation angle may be used, such as a rotation angle larger than 60° and/or smaller than 120°, such as 90°.

Figure 5:
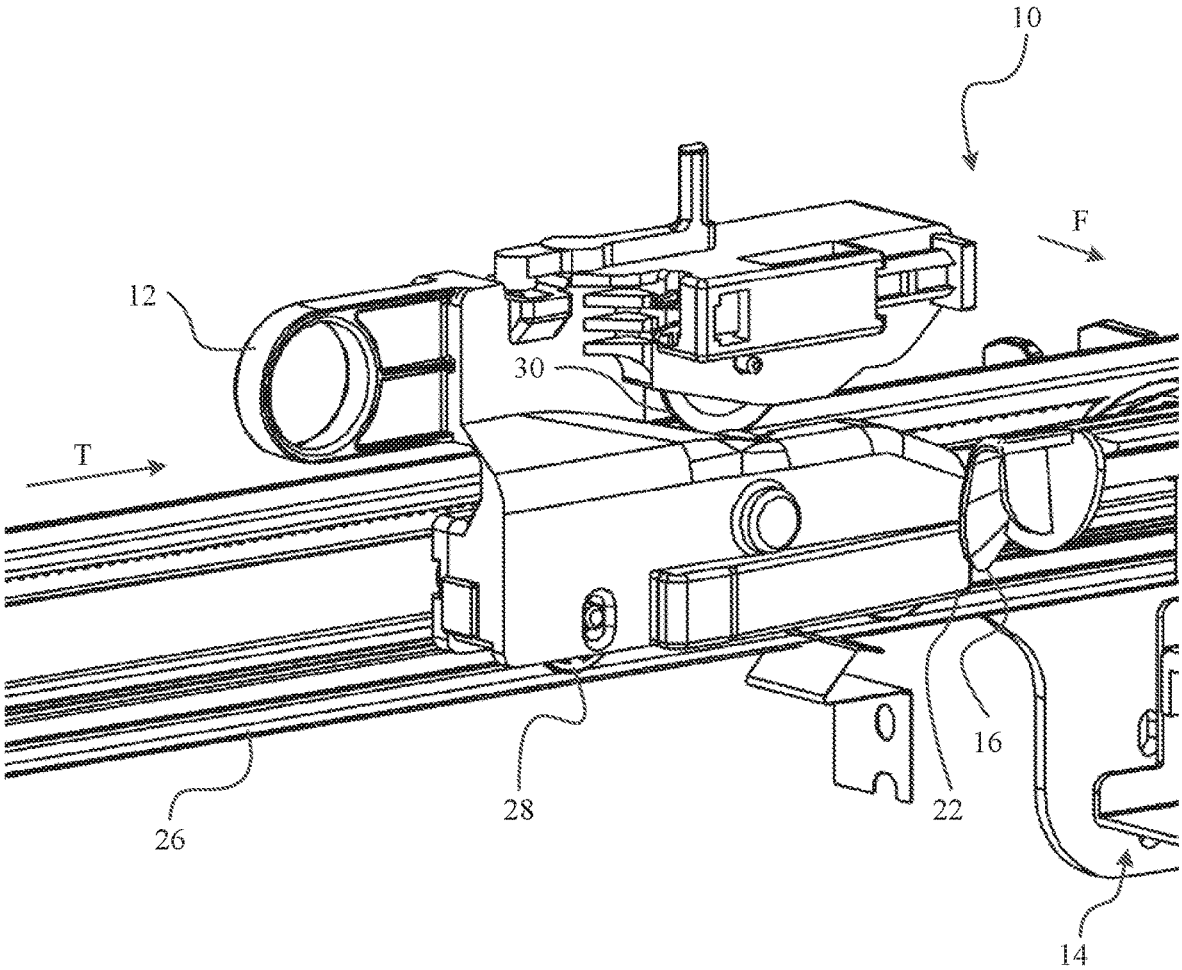
FIG. 5 illustrates a perspective view of a cutter assembly wherein a cutter engages a trench cover according to an example.

FIG. 5 illustrates the engaging of the trench cover 16 with the engaging element 22 of the horizontal cutter 12 at a first side 32 of the trench cover 16. In FIG. 5, the first side 32 of the trench cover 16 is located at an end of the trench cover 16 in a direction perpendicular to the feeding direction F. When moving the cutter 12 along the rail 26 according to a displacement direction T (i.e. the cutting direction of the horizontal cutter) from a resting position at the stop element 26*s* (not shown, but located on the left side of the cutter 12 along the rail 26) towards the first side 32 of the trench cover 16 to cut the printable medium P, the engaging surface 22 of the cutter 12 initially engages the first side 32 of the trench cover 16 to move the trench cover 16 between the supporting configuration C1 and the open configuration C2.

To facilitate moving the trench cover 16 between the supporting configuration C1 and the open configuration C2, the trench cover 16 may comprise a slanted portion 34 at the first side 32 of the trench cover 16. According to the example displayed in FIG. 5, the slanted portion 34 comprises a curved portion, to reduce and/or smooth an opening force during the movement of the trench cover 16 between the supporting configuration C1 and the open configuration C2 against the bias of the elastic element 18 biasing the trench cover 16 towards the supporting configuration C1.

Figure 6:
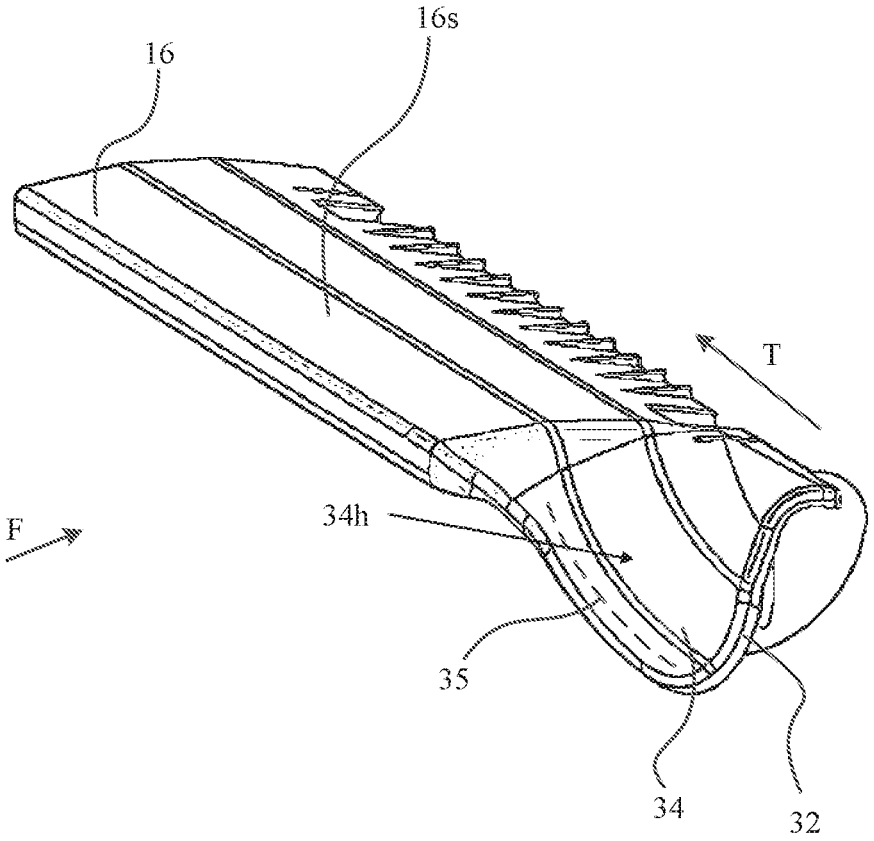
FIG. 6 illustrates a perspective view of a side of a trench cover with a helicoidal surface according to an example.

The slanted portion 34 at the first side 32 of the trench cover 16 is further illustrated in FIG. 6. In the illustrated example, the slanted portion 34 comprises a helicoidal portion 34*h* and is adjacent to the first side of the trench cover 16. The surface normal of the trench cover 16 changes along a surface line 35 following the displacement direction T in the helicoidal portion 34*h* from an orientation almost perpendicular to the displacement direction T towards a direction, which is almost parallel to the displacement direction T.

The slanted and/or curved and/or helicoidal portion 34, 34*h* may reduce the maximum force to move the trench cover 16 from the supporting configuration C1 into the open configuration C2 when compared to a trench cover 16 without a slanted, curved and/or helicoidal portion 34, 34*h*.

When an engaging surface of the engaging element 22 (not shown) of the cutter engages the first side 32 of the trench cover 16 to move the trench cover 16 into the open configuration C2, the trench cover 16 is rotated and as a consequence, the angle between a normal of a supporting surface 16*s* of the trench cover 16 and a normal of the engaging surface of the engaging element 22 may change continuously which can lead to a change of the magnitude of the force component induced by the engaging element 22 onto the trench cover 16 along the normal of the supporting surface 16*s*.

However, the helicoidal shape of the surface of the helicoidal portion 34*h* may reduce the change of the magnitude of the force component induced by the linear movement of the engaging element 22 onto the trench cover 16 during the rotational movement of the trench cover 16. In other words, the mechanical work for moving the trench cover 16 from the supporting configuration C1 into the open configuration C2 against the bias of the elastic element 18 may be distributed along a displacement distance along the displacement direction T by the slanted and/or curved and/or helicoidal portion 34, 34*h*, wherein the displacement distance may be the spatial extent of the slanted and/or curved and/or helicoidal portion 34, 34*h* along the displacement direction.

The displacement distance and the force components inducing a torque onto the trench cover 16 may be controlled by the curvature of the slanted and/or curved and/or helicoidal portion 34, 34*h*. Hence, the driving force for moving the cutter 32 can be limited and/or smoothed during the engaging of the trench cover 16 with the engaging element 22 by selecting the curvature of the slanted and/or curved and/or helicoidal portion 34, 34*h*.

In some examples, the magnitude of the force component induced by the engaging element 22 onto the trench cover 16 along the normal of the supporting surface 16*s* during the movement of the trench cover 16 between the supporting configuration C1 and the open configuration C2 remains largely constant or experiences a small variation, such as a variation smaller than 20%.

In some examples, the torque induced by the engaging element 22 onto the trench cover 16 may be constant or experiences a small variation, such as a variation smaller than 20%, while the engaging element 22 of the cutter 12 engages the slanted and/or curved and/or helicoidal portion 34, 34*h* of the trench cover 16 during the movement of the trench cover 16 between the supporting configuration C1 and the open configuration C2.

Figure 7A:
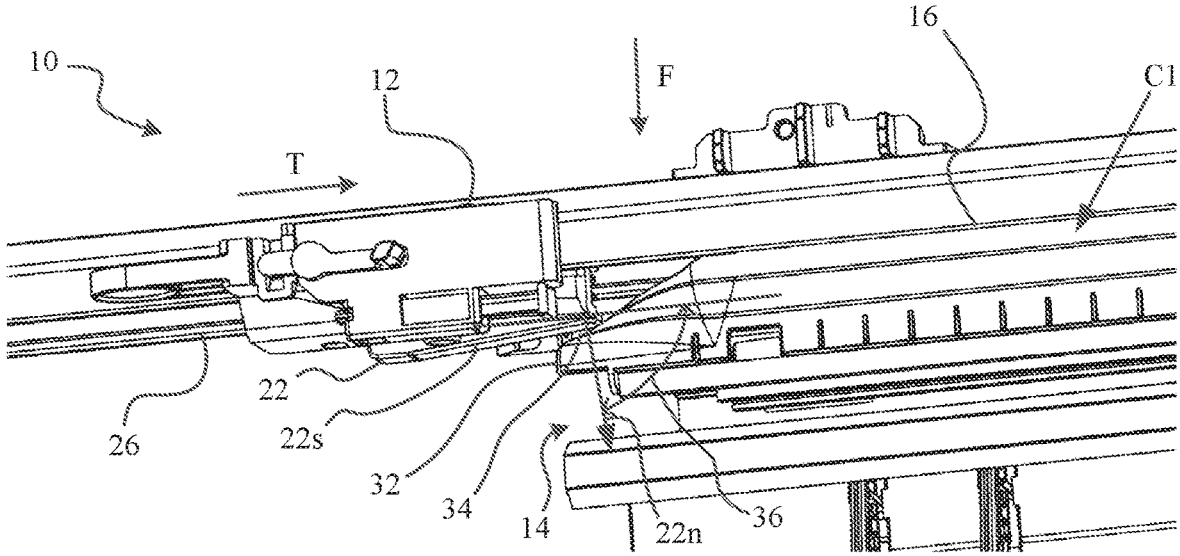
FIG. 7A illustrates a perspective view of a cutter assembly wherein a cutter engages a trench cover and the trench cover is in the supporting configuration according to an example.

FIG. 7A shows a top view of the engaging of the trench cover 16 by the engaging element 22 of the cutter 12, the trench cover 16 being in the supporting configuration C1.

Figure 7B:
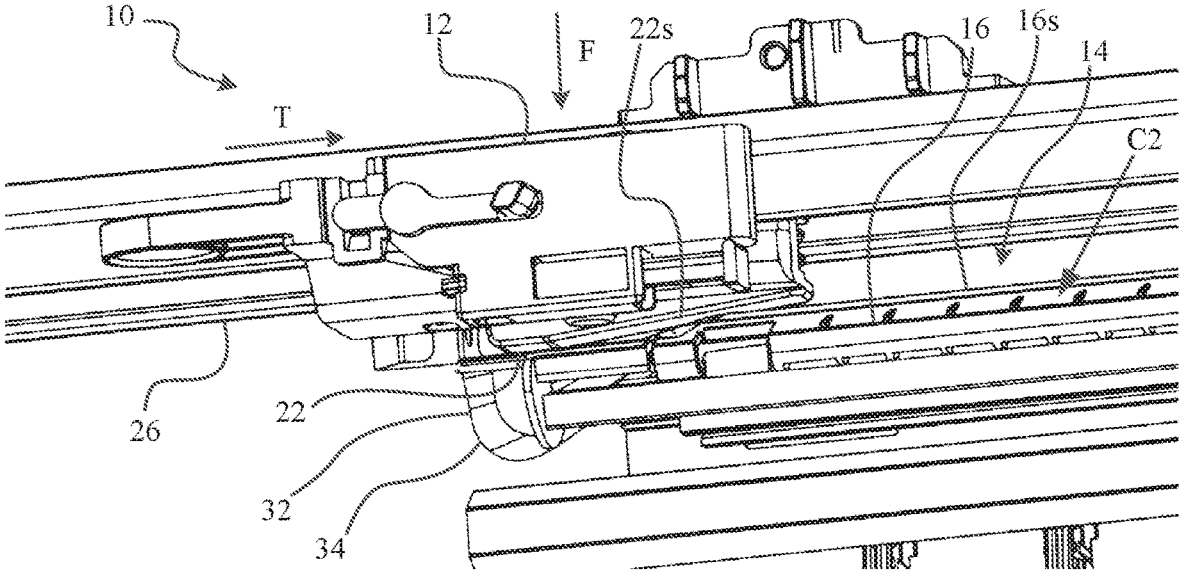
FIG. 7B illustrates a perspective view of a cutter assembly wherein a cutter engages a trench cover and the trench cover is in the open configuration according to an example.

As shown in FIGS. 7A and 7B, the engaging element 22 may comprise a sloped surface 22*s* to engage the trench cover 16. The sloped surface 22*s* may be tilted with respect to the cutting direction T. In some examples, an angle 36 between a normal 22*n* of the sloped surface 22*s* and the cutting direction T is between 89° and 60° or between 85° and 70°, such as 80°.

FIG. 7B shows the same top view of the engaging of the trench cover 16 by the engaging element 22 of the cutter 12 as FIG. 7A; however, in FIG. 7B the trench cover 16 is in the open configuration C2.

In the open configuration C2, the trench cover 16 is rotated to open a connection to the trench 14 to receive portions P1 of the printable medium P in the trench 14. As illustrated in FIG. 7B, the engaging element 22 may engage a portion of the supporting surface 16*s* of the trench cover 16 to keep the trench cover 16 in the open configuration C2. The cutter 12 may then cut the printable medium P along the horizontal direction while the trench 14 may receive portions P1 of the printable medium P.

To move the trench cover 16 towards the supporting configuration C1 when the engaging element 22 of the cutter 12 no longer engages the trench cover 16, the trench cover 16 may be fitted with torsional springs 18.

Figure 8:
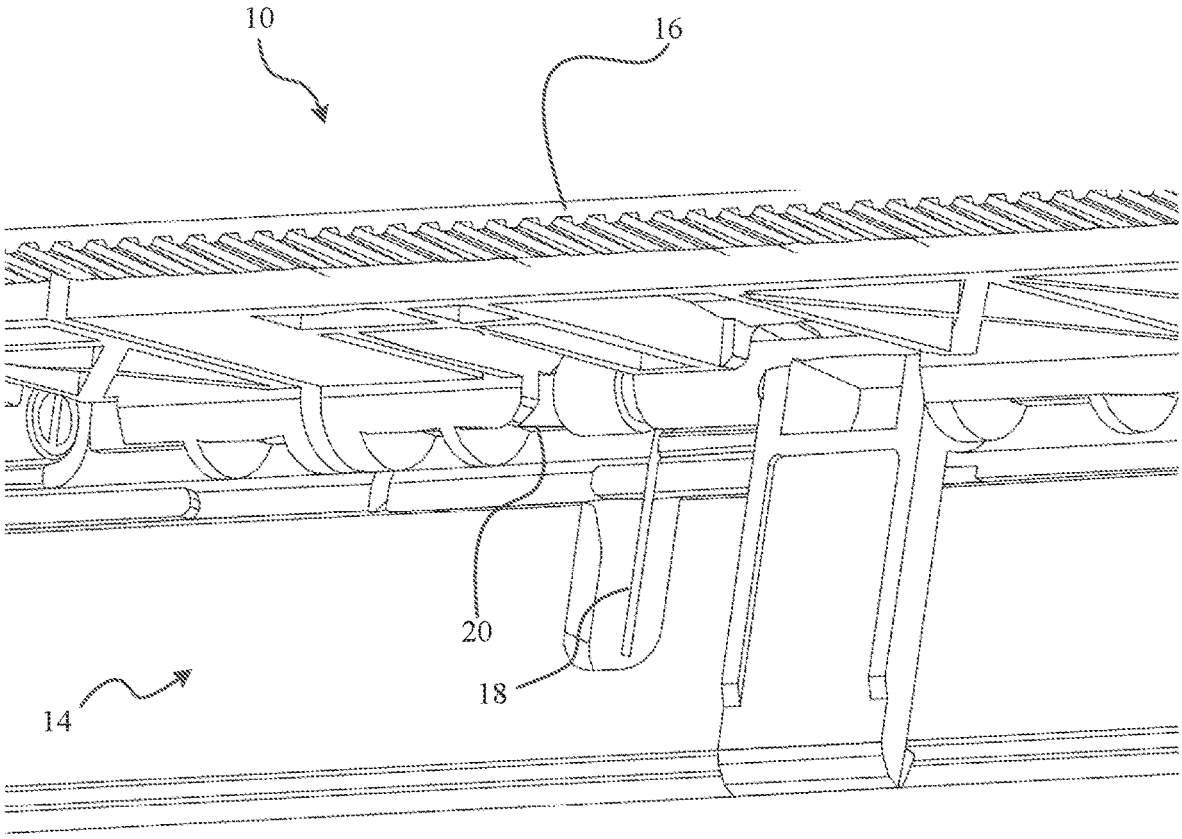
FIG. 8 illustrates a perspective view of the bottom side of a trench cover illustrating an elastic element according to an example.

FIG. 8 shows a bottom view of the trench cover 16 in a supporting configuration C1 to cover the trench 14 of the cutter assembly 10, wherein a torsional spring 18 functioning as the elastic element 18 is placed close to the axis of rotation 20 and is connected to the trench cover 16 and a base of the cutter assembly 10.

When rotating the trench cover 16 about the axis of rotation 20 from the supporting configuration C1 towards the open configuration C2, the torsional spring 18 may be contracted and may thereby provide a restoring force to move the trench cover 16 towards the supporting configuration C1. The spring constant of the torsional spring 18 may be chosen such that the trench cover 16 remains in the supporting configuration C1 when the trench cover 16 supports the printable medium P, and is moved towards the open configuration C2 when the engaging element 22 of the cutter 12 engages the first side 32 of the trench cover 16.

For example, an opening force to move the trench cover 16 against the restoring force of the elastic element 18 from the supporting configuration C1 into the open configuration C2 by engaging the slanted surface 34 of the trench cover 16 may be larger than 1 N and/or smaller than 10 N and/or smaller than 5 N, such as 3.5 N. When the trench cover 16 is in the open configuration C2 and the engaging element 22 engages the supporting surface 16*s* of the trench cover 16 to keep the trench cover 16 in the open configuration C2, an additional frictional force may be induced by the trench cover 16 onto the cutter 12, which may be smaller than the opening force, such as a frictional force of 2 N.

Figure 9:
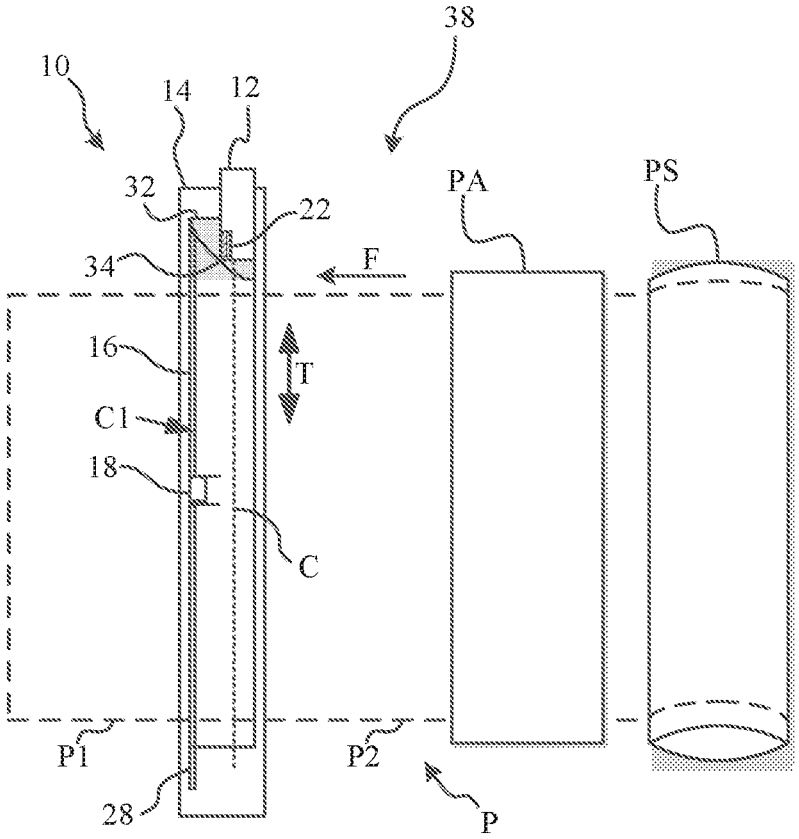
FIG. 9 illustrates a schematic top view of a printer with a cutter assembly according to an example.

FIG. 9 illustrates an example of a printer 38 comprising a cutting stage 10 to cut the printable medium P, the cutting stage 10 comprising a cutter 12. The printer 38 further comprises a trench 14 adjacent to the cutter 12 to receive offcuts P1 of the printable medium P, and a trench cover 16 configured to be movable between a supporting configuration C1 to support the printable medium P, and an open configuration C2 to guide the printable medium P into the trench 14. The printer 38 also comprises an elastic element 18 for biasing the trench cover 16 towards the supporting configuration C1, and the cutter 12 comprises an engaging element 22 that engages the trench cover 16 to move the trench cover 16 from the supporting configuration C1 towards the open configuration C2 when the cutter 12 moves or cuts the printable medium P.

The trench cover 16 may comprise a slanted and/or curved and/or helicoidal portion 34, 34*h* at a side 32 of the trench cover 16, wherein the engaging element 22 engages the slanted and/or curved and/or helicoidal portion 34, 34*h* at the side 32 of the trench cover 16 to actuate and open the trench cover 16 when the cutter 12 is moved to cut the printable medium P.

The printable medium P may be provided by a printable medium source PS and a printing fluid may be applied onto the printable medium P in the printing area PA, which may be upstream of the cutter assembly 10.

Figure 10:
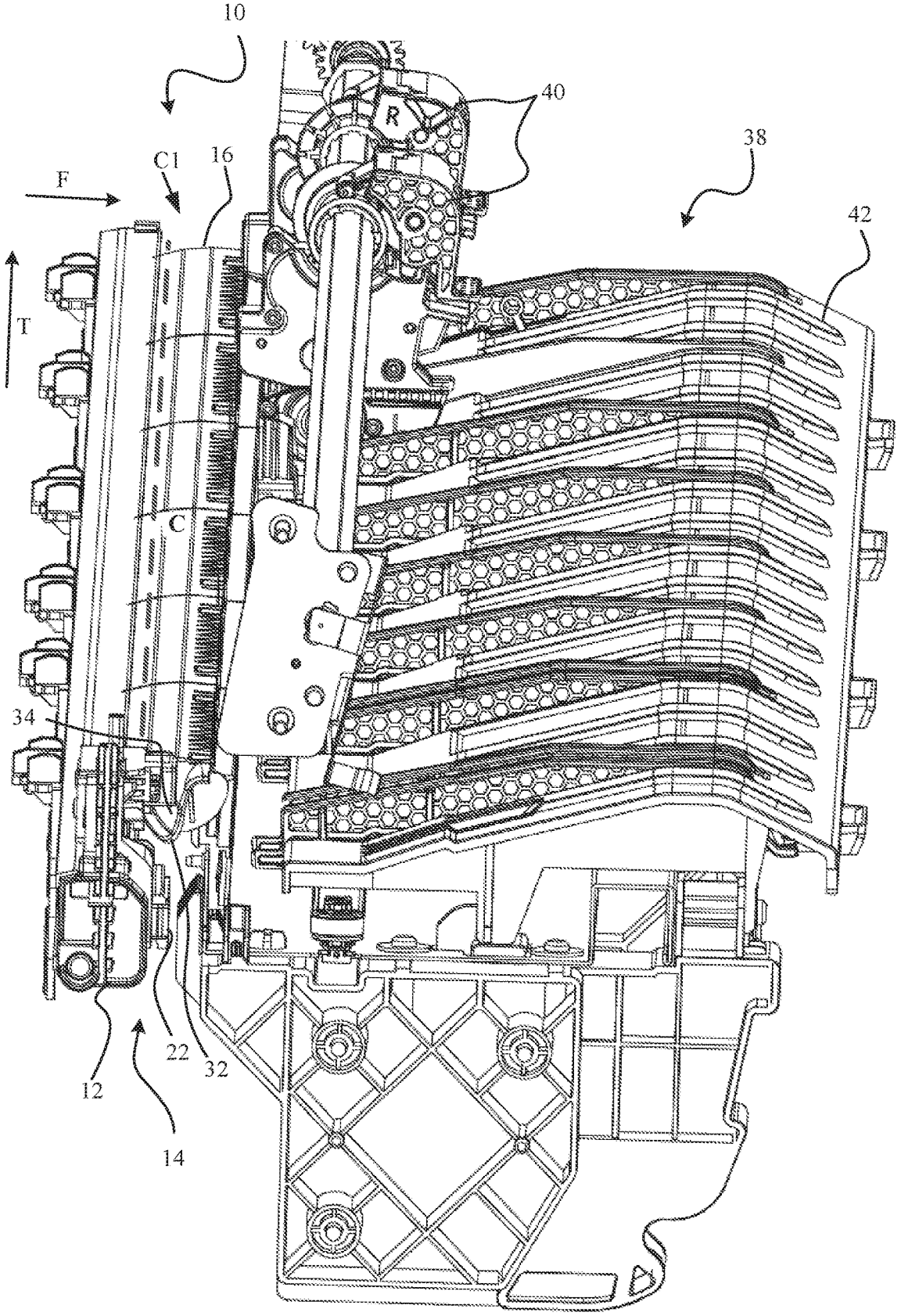
FIG. 10 illustrates a perspective view of a printer with a cutter assembly and a movable trench cover according to an example.

FIG. 10 shows a perspective view of a cutting stage 10 of a printer 38 similar to the printer schematically shown in FIG. 9. The printer 38 also comprises a cutting stage 10 to cut the printable medium P, the cutting stage 10 comprising a cutter 12, a trench 14 adjacent to the cutter 12 to receive offcuts P1 of the printable medium P, and a trench cover 16 configured to be movable between a supporting configuration C1 to support the printable medium P, and an open configuration C2 to guide the printable medium P into the trench 14.

In the examples of FIGS. 9 and 10, the cutter 12 is a horizontal cutter 12 to cut the printable medium P in a horizontal direction T, but this is a mere example, and in other embodiments the cutter 12 can cut in other directions.

The printer 38 illustrated in FIG. 10 further comprises a vertical cutter 40 to cut the printable medium P in a vertical direction F, the vertical direction F being substantially parallel to a feeding direction F of the printable medium P, and the vertical cutter 40 being located downstream of the horizontal cutter 12 with respect to a feeding direction F of the printable medium P. Hence, the printer 38 can control the length as well as the width of the cut portion P1 of the printable medium P.

In some examples, the trench cover 16 guides the printable medium P into the vertical cutter 40 when the trench cover 16 is in the supporting configuration C1 and/or may guide the printable medium P into the trench 14 when the trench cover 16 is in the open configuration C2. Guiding the printable medium P into the vertical cutter 40 may guide the printable medium P into an elevated position above the horizontal cutter 12.

As shown in FIG. 10, the cutting stage 10 may be adjacent to an output stage 42 to guide the portions P1 of the printable medium P. In some examples, the printer 38 guides the printable medium P towards an output stage 42 of the printer 38 or into the trench 14 depending on the length of a cut portion P1 of the printable medium P after it has been cut by the cutter 12.

For example, when the horizontal cutter 12 cuts a short portion P1 of the printable medium P along the cutting line C, such as a ¼ inch strip of printable medium P, to modify the edge of the printable medium P2, the trench 14 may receive the short portion P1 of the printable medium P. However, when the cutter 12 cuts the printable medium P1 and P2, such that the cut portion P1 has larger dimensions, such as dimensions greater than the height and/or length of a letter size page or DIN A4 size page, the cut portion P1 may be guided towards the output stage 42 by the shape of the support structures of the output stage 42.

The printer 38 may comprise a support structure having a first and a second portion adjacent to the output stage 42 of the printer 38, the first portion guiding the cut portions P1 into the trench 14, while the second portion guides the cut portions P1 of the printable medium P towards the output stage 42. For example, when the length of the cut portion P1 is larger than twice the length of the first portion, the cut portion P1 may be automatically guided towards the output stage 42. In some examples, the first portion comprises the trench 14.

In some examples, the printable medium P is guided into and/or through the vertical cutter 40 and towards an output stage 42, when the trench cover 16 is in the supporting configuration C1.

Figure 11:
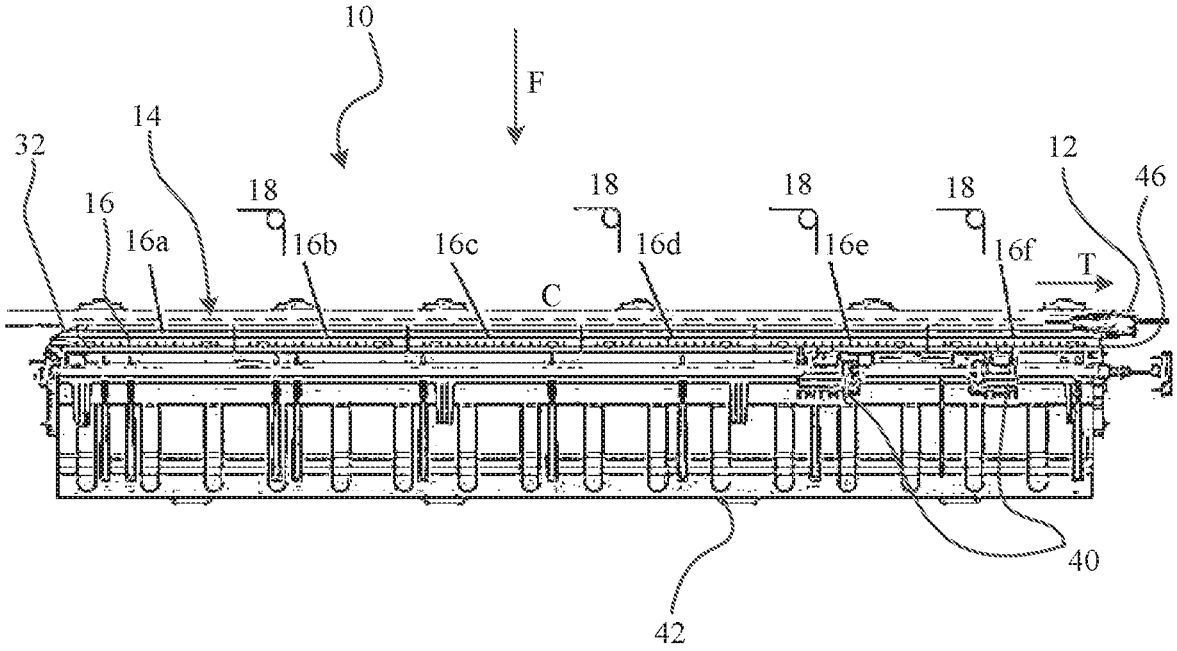
FIG. 11 illustrates a top view of a cutter assembly of a printer with a movable trench cover according to an example.

A top view of a cutting stage 10 of a printer 38 is illustrated in FIG. 11. The cutting stage 10 comprises a trench 14 and a trench cover 16 in an open configuration C2 to receive portions P1 of the printable medium P. A horizontal cutter 12 engages the trench cover 16 to move the trench cover 16 towards the open configuration C2.

The trench cover 16 of FIG. 11 is composed of a plurality of trench modules 16*a* to 16*f*, the trench modules 16*a* to 16*f* being connected, such that the movement of trench modules 16*a* to 16*f* is coupled.

In addition, the trench cover 16 comprises a plurality of elastic elements 18 distributed along the displacement direction T of the cutter 12, the position of the elastic elements 18 being indicated by torsional spring symbols adjacent to the respective trench module 16*a* to 16*f* which accommodates the respective elastic element 18. In the example of FIG. 11, the trench modules 16*b*, 16*d*, 16*e* and 16*f* each comprise an elastic element 18 to move the trench cover 16 towards the supporting configuration C1. The trench modules 16*a* and 16*c* do not accommodate an elastic element 18. Therefore the restoring force onto the trench cover 16 towards the supporting configuration C1 varies along the displacement direction T of the cutter 12.

The restoring force of the elastic element 18 or the plurality of elastic elements 18 may lead to a twist of the trench cover 16, for example when the engaging element 22 engages the trench cover 16. For example, when the cutter 12 has moved from the first side 32 of the trench cover 16 towards an opposite side 46 of the trench cover 16, the position of the trench cover 16 at the opposite side 46 may be fixed by the cutter 12, while a restoring force at the first side 32 of the trench cover 16 may twist the trench cover 16. A twisted trench cover 16 may obstruct a portion P1 of the printable medium P from entering the trench 14.

By varying the restoring force onto the trench cover 16 along the displacement direction T of the cutter 12, a twist of the trench cover 16 due to the restoring force of the elastic element 18 may be reduced. In this way, the elastic force acting on the opposite side 46 of the trench cover 16 and/or the elastic force of the sum of the elastic elements 18 to move the trench cover 16 towards the supporting configuration C1 may be increased without increasing the twist of the trench cover 16 close to the first side 32 of the trench cover 16.

In some examples, the elastic element 18 comprises a plurality of springs, such as torsional springs, the plurality of springs being distributed along the cutting direction C along the trench cover 16.

In some examples, the cutter 12 cuts the printable medium P along the cutting direction C from a first side 32 of the trench cover 16 to a second side 46 of the trench cover 16 opposite to the first side 32, wherein the bias of the elastic element 18 varies along the cutting direction C or is smaller at the first side 32 of the trench cover 16 than on the second side 46 of the trench cover 16.

The bias of the elastic element 18 may be varied by providing a plurality of elastic elements 18 as described above, wherein the bias is varied by modifying the spring constant of the elastic elements 18 or by varying the distribution of the elastic elements 18 along the cutting line C. However, the bias of the elastic element 18 may also vary along the cutting direction C due to an intrinsic property of an elongated elastic element 18, the intrinsic property providing a restoring force which varies along the displacement direction T, such as an elastic element 18 implemented with a twisted deformable material.

In some examples, the position of the elastic element 18 to bias the trench cover 16 towards the supporting configuration C1 along the cutting line C is farther from the first side 32 than from a second side 46 opposite to the first side 32 of the trench cover 16.

Figure 12:
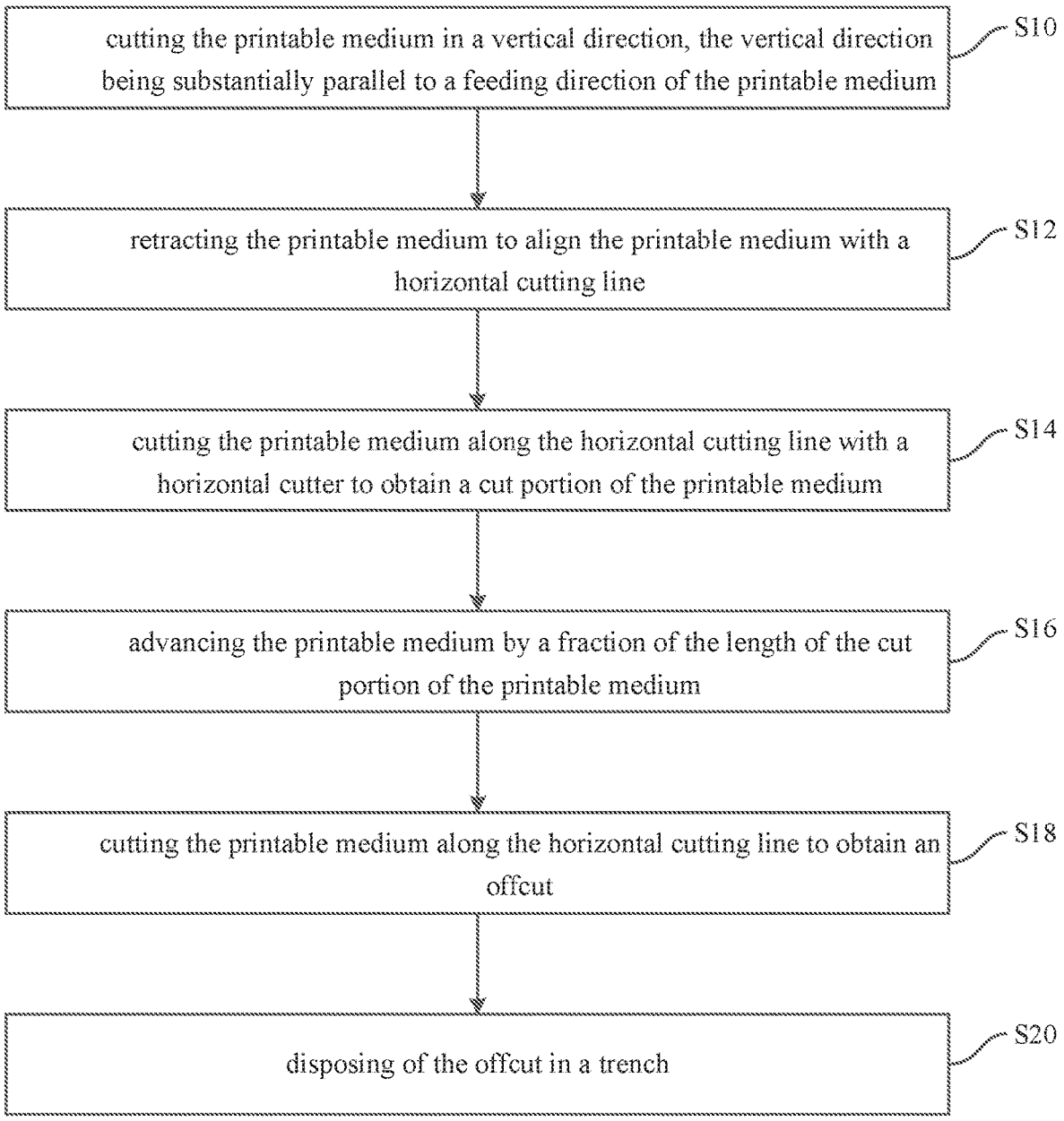
FIG. 12 illustrates a flow diagram for a method to cut a printable medium according to an example.

FIG. 12 illustrates a flowchart of a method for cutting a printable medium P. The method comprises cutting the printable medium P in a vertical direction F, the vertical direction F being substantially parallel to a feeding direction F of the printable medium P (S10); retracting the printable medium P to align the printable medium P with a horizontal cutting line C (S12); cutting the printable medium P along the horizontal cutting line C with a horizontal cutter 12 to obtain a cut portion P1 of the printable medium P (S14); advancing the printable medium P by a fraction of the length of the cut portion P1 of the printable medium P (S16); and cutting the printable medium P along the horizontal cutting line T to obtain an offcut P1 (S18), and disposing of the offcut P1 in a trench 14 (S20).

The method illustrated in FIG. 12 may be implemented in a printer 38, cutting stage 10 or cutter assembly 10 according to any of the previous examples. By cutting the printable medium P according to the method, overcuts or print marks on the edges of cut portions P1, P2 of the printable medium P may be removed from the subsequent portion P2 of the printable medium P.

For example, a vertical cutter 40 may cut the printable medium P in a vertical direction prior to performing a horizontal cutting step by a horizontal cutter 12 to obtain the cut portion P1 of the printable medium P. In a subsequent alignment step, wherein the printable medium P is aligned with the horizontal cutting line C, alignment errors may lead to overcuts remaining on the subsequent portion P2 of the printable medium P upstream of the cut portion P1. By removing an offcut P1 of the subsequent portion P2 of the printable medium P in a subsequent horizontal cutting step and disposing of the offcut P1 in the trench 14, the edge of the subsequent portion P2 upstream of the cut portion P1 may be provided with a clean edge without overcuts.

Similarly, cutting the printable medium P along the horizontal cutting line T to obtain the offcut P1 may also remove print marks left after the printing process for a plot of the printable medium P from subsequent portions P2 of the printable medium P.

In some examples, the fraction of the length of the cut portion P1 has a length smaller than 1 inch, such as smaller than ¼ inch.

In some examples, the disposing of the offcut P1 comprises opening a connection to a trench 14 adjacent to the horizontal cutter 12.

To receive the offcut in the trench 14 the width of the trench may be larger than ¼ inch, such as larger than 0.4 inch, and/or may be smaller than 4 inch, such as smaller than 1 inch.

In some examples, the opening the connection to the trench 14 comprises opening a hatch 16 covering the trench 14 by engaging the hatch 16 with an engaging portion 22 of the cutter 12 to actuate the hatch 16 from a closed configuration C1 into an open configuration C2.

The hatch 16 may be a trench cover 16 and may feature any of the features described above with respect to examples of trench covers 16 in cutter assemblies 10 and the closed configuration C1 may be a supporting configuration C1. For example, the hatch 16 may comprise a slanted portion 34, such as a helicoidal portion 34*h* and the first side 32 of the hatch 16 to engage in engaging portion 22 of the horizontal cutter 12 during and/or after the cutting of the printable medium P to open the connection to the trench 14 and dispose of the offcut P1 in the trench 14.

In some examples, the hatch 16 is fitted with an elastic element 18 to bias the hatch 16 towards a closed position C1, wherein the opening of the trench 14 comprises overcoming the bias of the elastic element 18 by engaging the side surface 32, 16*s* of the hatch 16 with the engaging portion 22 of the cutter 12. However, in some examples, the engaging of the side surface 32, 34, 34*h*, 16*s* of the hatch 16 is decoupled from the cutting of the printable medium P and the side surface 32, 34, 34*h*, 16*s* of the hatch 16 may be engaged by an engaging element not associated with the cutter 12.

The invention claimed is:

1. A cutter assembly for a printable medium comprising:
- a cutter to cut the printable medium;
- a trench adjacent to the cutter; and
- a trench cover, the trench cover at least partially covering the trench and being movable between
  - a supporting configuration to support the printable medium, and
  - an open configuration to receive portions of the printable medium in the trench;
- wherein the cutter assembly comprises an elastic element for biasing the trench cover towards the supporting configuration;
- wherein the cutter comprises an engaging element;
- wherein the engaging element engages the trench cover to move the trench cover from the supporting configuration towards the open configuration;
- wherein the cutter is adapted to move along the trench in a cutting direction; and
- wherein the engaging element engages the trench cover when the cutter moves or cuts the printable medium.

2. The cutter assembly of claim 1, wherein the engaging element comprises a sloped surface to engage the trench cover;
- wherein the sloped surface is tilted with respect to the cutting direction; or
- wherein an angle between a normal of the sloped surface and the cutting direction is between 89° and 60°, or between 85° and 70°.

3. The cutter assembly of claim 1, wherein the cutter cuts the printable medium along the cutting direction from a first side of the trench cover to a second side of the trench cover opposite to the first side, and wherein the bias of the elastic element varies along the cutting direction or is smaller at the first side of the trench cover than on the second side of the trench cover.

4. The cutter assembly of claim 1, wherein the trench cover comprises a slanted and/or curved and/or helicoidal portion at a first side of the trench cover.

5. The cutter assembly of claim 1, wherein the elastic element comprises a plurality of springs, the plurality of springs being distributed along a cutting direction along the trench cover.

6. A printer comprising
- a cutting stage to cut the printable medium, the cutting stage comprising a cutter;
- a trench adjacent to the cutter to receive offcuts of the printable medium; and
- a trench cover configured to be movable between
  - a supporting configuration to support the printable medium, and
  - an open configuration to guide the printable medium into the trench;
- the printer comprising an elastic element for biasing the trench cover towards the supporting configuration, and
- wherein the cutter comprises an engaging element that engages the trench cover to move the trench cover from the supporting configuration towards the open configuration when the cutter moves or cuts the printable medium.

7. The printer of claim 6, wherein the elastic element comprises a plurality of springs, and a bias produced by the springs is smaller on a first side of the trench cover comprising the slanted portion than on a second side opposite to the first side.

8. The printer of claim 6, wherein the trench cover comprises a slanted and/or curved and/or helicoidal portion at a side of the trench cover, wherein the engaging element engages the slanted and/or curved and/or helicoidal portion at the side of the trench cover to actuate the trench cover when the cutter is moved to cut the printable medium.

9. The printer of claim 6, wherein the printer guides the printable medium towards an output stage of the printer or into the trench depending on the length of a cut portion of the printable medium after it has been cut by the cutter.

10. The printer of claim 6, wherein the cutter is a horizontal cutter to cut the printable medium in a horizontal direction and wherein the printer further comprises a vertical cutter to cut the printable medium in a vertical direction, the vertical direction being substantially parallel to a feeding direction of the printable medium, the vertical cutter being located downstream of the horizontal cutter with respect to a feeding direction of the printable medium.

* * * * *